United States Patent [19]

Aumann

[11] 4,256,192

[45] Mar. 17, 1981

[54] PRESSURE CORE BARREL

[75] Inventor: James T. Aumann, Salt Lake City, Utah

[73] Assignee: Christensen, Inc., Salt Lake City, Utah

[21] Appl. No.: 55,471

[22] Filed: Jul. 6, 1979

[51] Int. Cl.[3] ..... E21B 25/00

[52] U.S. Cl. ..... 175/233; 175/242

[58] Field of Search ..... 175/59, 233, 242, 250

[56] References Cited

U.S. PATENT DOCUMENTS

| | | | |
|---|---|---|---|
| 2,238,609 | 4/1941 | Sewell | 175/233 |
| 2,381,845 | 8/1945 | Stokes | 175/233 |
| 2,734,719 | 2/1956 | Otway | 175/242 |
| 3,548,958 | 12/1970 | Blackwell | 175/233 |

*Primary Examiner*—James A. Leppink

[57] ABSTRACT

This invention relates to improvements in pressure core barrels of the type described in U.S. Pat. No. 3,548,958 wherein a controlled pressure is maintained on a core sample during surfacing. Among the improvements provided by the present invention are an improved arrangement of the pressure control valve, a means for positively latching the assembly (both in the open and closed positions) and the provision of a hydraulic assist for moving the outer barrel to the sealing position. Another feature provides an improved device for flushing of the mud from the core sample while it is under high pressure to facilitate the further sampling of the core after freezing of the section.

8 Claims, 11 Drawing Figures

FIG 1.A

PRESSURE CORE BARREL

TECHNICAL FIELD

This invention relates to the recovery of core barrel samples from the bottom of an oil well where it is desired to seal the core barrel sample and maintain it under the pressure existing at the bottom of the well when the sample is brought to the surface of the well. The invention also provides for positive indication at the well surface that the outer barrel is locked in sealing position and that the valve at the bottom of the core barrel is closed.

BACKGROUND OF THE INVENTION AND PRIOR ART

The present invention relates to a pressure core barrel assembly for recovering a core at formation pressure and is specifically directed to improvements in the type of pressure core barrel described in U.S. Pat. No. 3,548,958 issued 12/27/70 to Blackwell and Rumble. In such a pressure core barrel assembly it is important to know that the pressure core barrel has been sealed at formation pressure before the barrel is raised to the surface. If it is not sealed the sample will not be representative of the actual conditions existing in the formation at the bottom of the well.

SUMMARY OF THE INVENTION

The present invention provides an improved pressure core barrel of the type generally described in the above Blackwell et al Pat. No. 3,548,958 which has a number of improved features. First, the outer barrel (containing within it the core barrel) which is to seal the assembly at formation pressure is positively latched in both the raised (coring) position and the lowered (sealing) position. The arrangement of parts also provides for positive hydraulic assist for moving the outer barrel downwardly during the sealing operation to overcome any friction present at the bottom of the well. This is accomplished by using full mud hydraulic pressure both for triggering the latching mechanism and also for driving the outer barrel downward. Additionally, this hydraulic pressure is not released until the outer barrel has traveled substantially completely to the bottom position. Another feature of the invention provides that the pressurizing gas valve is not opened until the outer barrel has been lowered essentially to the closed position and the core sealing valve is being operated. Another feature provides for spring loaded actuation of the core sealing valve to prevent damage to the valve actuating mechanism in the event of jamming thereof. Another feature of the invention provides for the use of heavy duty splines and locking dogs which permit locking in both the open and closed position and also the transmission of torque in both open and closed positions. Other detailed advantages and improvements in the present invention will be apparent from the following discussion.

DETAILED DESCRIPTION OF THE INVENTION

In order to understand the details of the invention reference should be had to the following drawings which describe the preferred non-limiting example of the invention. In these figures (where possible) reference numerals have been used which are the same as those used in the equivalent elements of Blackwell et al U.S. Pat. No. 3,548,958. In these drawings FIG. 1 is a schematic diagramatic partially sectional view of the top part of the pressure core barrel assembly in the coring position.

Figure 1:
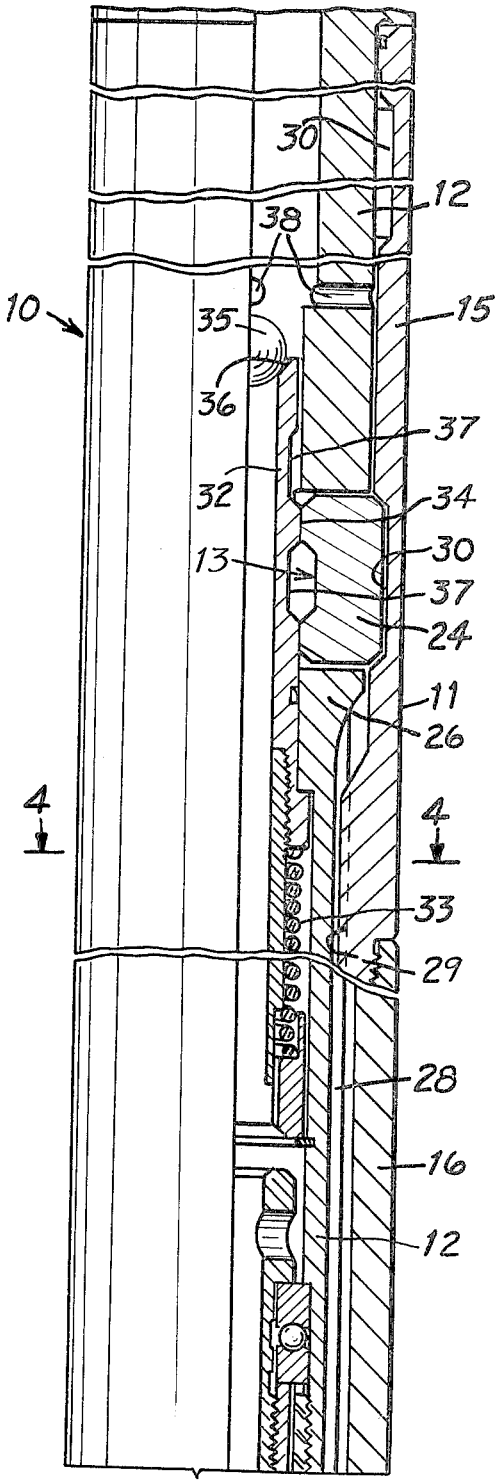
FIG. 1A shows the next lower section of the core barrel assembly where the pressurizing gas source and its valves are located, the assembly being in the coring position.
FIG. 1B illustrates the next lower section of the core barrel assembly showing the details of the gas pressurizing valve and the spring mechanism for protecting the core sealing valve, FIG. 1B being in the open coring position.
FIG. 1C shows the details of the bottom of the core barrel assembly in the open position and FIG. 2C shows the same portion of the core assembly in the sealed position.
Figure 2:
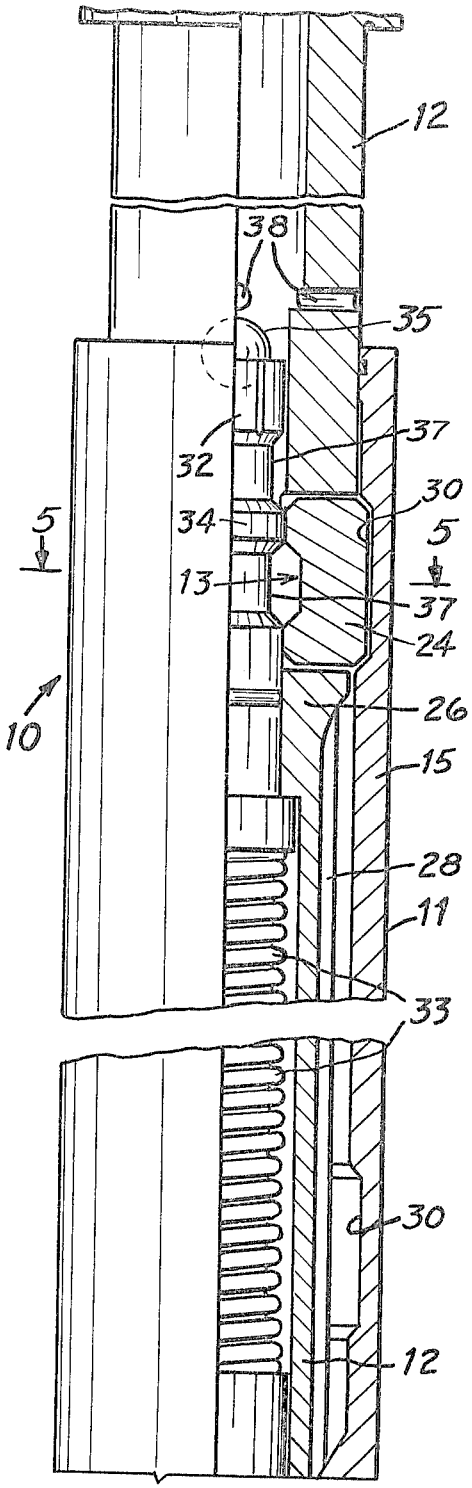
FIG. 2 is similar to FIG. 1 with the core barrel assembly in the sealed position.
Figure 3:
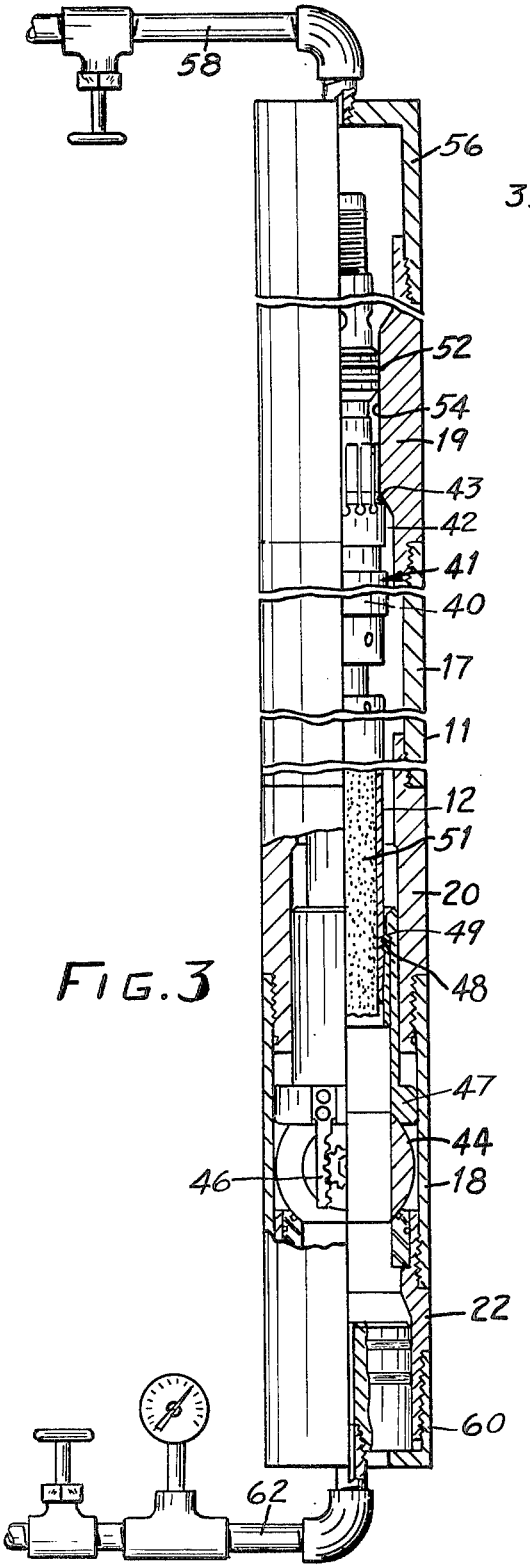
FIG. 3 shows the sealed core barrel assembly mounted in a pressurized flushing system for flushing drilling mud from the core barrel assembly prior to the freezing of the assembly for sectioning and analysis.

Referring now the details shown in FIGS. 1 thru 3 the construction of the core barrel assembly 10 includes an outer barrel 11 and an inner barrel 12 interconnected by a slip joint assembly generally indicated at 13. The outer barrel assembly 11 is made up of a number of sections indicated at 15, 16, 17 and 18 with several connecting subs 19 and 20. The bottom of the outer barrel assembly is provided with a sub 22 adapted to be connected to the core bit (not shown). Inner core barrel 12 is arranged to be supported by the drill string by means of a connection at the top thereof (not shown).

Referring now to the specific detail of construction as shown in FIGS. 1 and 2 it can be seen that the outer core barrel 11 is held in the upper (open) position by means of three dogs 24 carried by an enlarged splined upper section 26 of the inner core barrel support mechanism 12.

Figure 4:
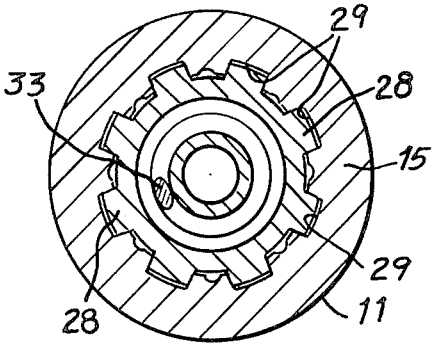
FIG. 4 is a sectional view taken along the line 4–4 of FIG. 1
Figure 5:
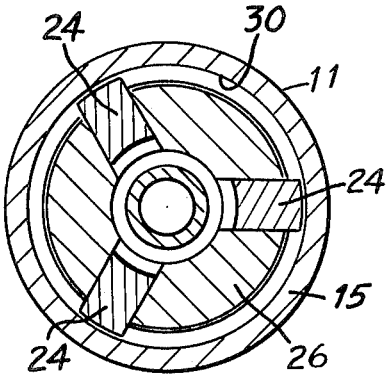
FIG. 5 is a sectional view taken along the line 5–5 of FIG. 2.

In FIG. 4 there is shown the spline 28 which engage female splines 29 on the outer barrel assembly. Details of the dogs 24 and their operative grooves 30 are shown in FIG. 5. As can be seen, there are three dogs which operate in the groove 30 and, in a preferred embodiment, there are eight splines. Accordingly rotation of the splines by one-eighth of a turn on each reassembly of the core barrel assembly provides for rotation of the dogs 24 to engage a different portion of the cylindrical groove 30, thus equalizing wear in these grooves.

Supported on the inner assembly is a latch actuating cylinder 32 which is held in the upper position (as shown) by spring 33. In this position the full diameter portion 34 of the cylinder 32 bears on the back surfaces of the latch dogs 24 and holds the latch dogs fully extended into the cylindrical groove 30. In FIG. 1 the latch dogs 24 are shown in the lower cylindrical groove 30 and in FIG. 2 they are shown engaged in the upper cylindrical groove 30.

FIG. 1 also shows ball 35 which has been pumped down into a valve seat 36 at the top of the hollow latch actuating cylinder 32. In normal operation, without the ball 35, the drilling mud passes down the axis of the core barrel through the hollow cylinder and down to the bottom of the core bit in accordance with standard coring practice. When the ball 35 is seated in the valve seat 36 the flow of drilling mud is interrupted and the pressure above the ball 35 increases tending to force the latch actuating cylinder 32 down. When the full diameter portions 34 of the latch actuating cylinder 32 have moved downwardly a sufficient amount to free the latch dogs for inward motion, these latch dogs are forced into cylindrical grooves 37 carried by the cylinder 32. This releases the outer barrel and permits it to travel from the open position to the closed position shown in FIG. 2. As the latch actuating cylinder 32 is forced downwardly by the hydraulic pressure bearing on the ball 35 it compresses the spring 33 as long as the full hydraulic pressure remains above the ball 35. As the outer barrel 11 moves downwardly the upper end thereof passes opening 38 which allows the full mud pressure to be vented to the exterior of the core barrel assembly. This releases the pressure above the ball 35 allowing the spring 33 to move the latch actuating cylinder 32 to the upward position thus forcing latch dogs 24 back outwardly when the upper cylindrical groove 30 reaches these dogs.

Referring to FIGS. 1A, 1B, 2A and 2B there are shown details of the pressure control system and its operating valve. This system in many respects is similar to the pressure control system as described in U.S. Pat. No. 3,548,958. There is similar pressurized nitrogen reservoir 40, a pressure regulator 41, a cut-off valve 42, and a valve actuator 43. In function these elements are essentially the same as the corresponding elements in Blackwell et al. In the present invention, however, the valve actuator is a shoulder 43 carried by the outer barrel assembly and is arranged to move the cut-off valve 42 downwardly when the outer barrel has reached its lower position. This permits pressurization of the core barrel assembly only after the core barrel assembly is approaching its sealed condition.

Figure 2A:
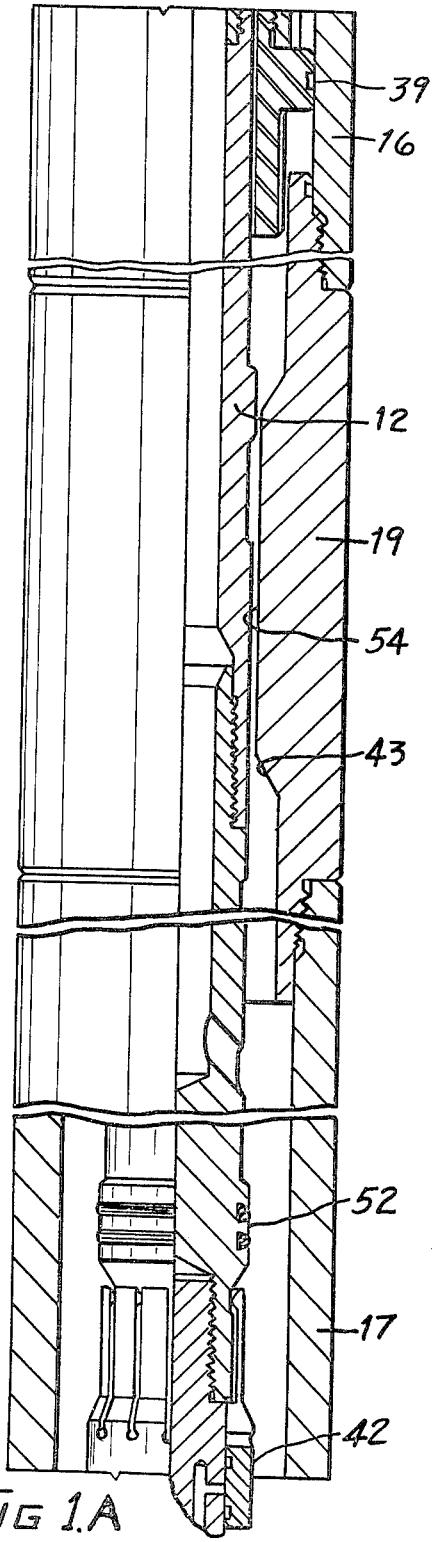
FIG. 2A is like FIG. 1A with the gas pressurizing valve assembly open and the core in the sealed condition.
Figure 2A:
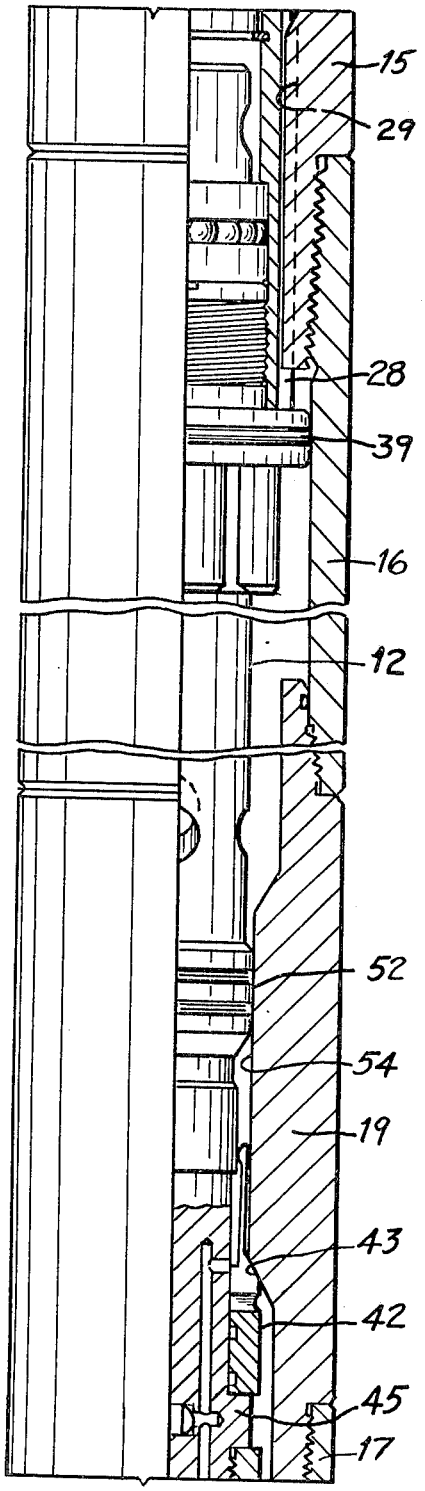
Figure 1B:
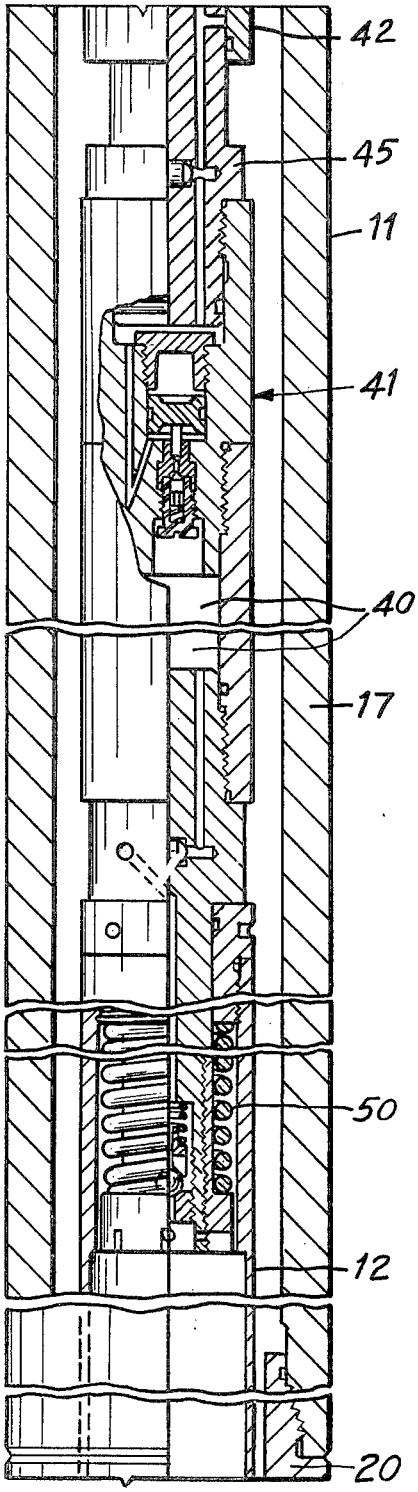
Figure 2B:
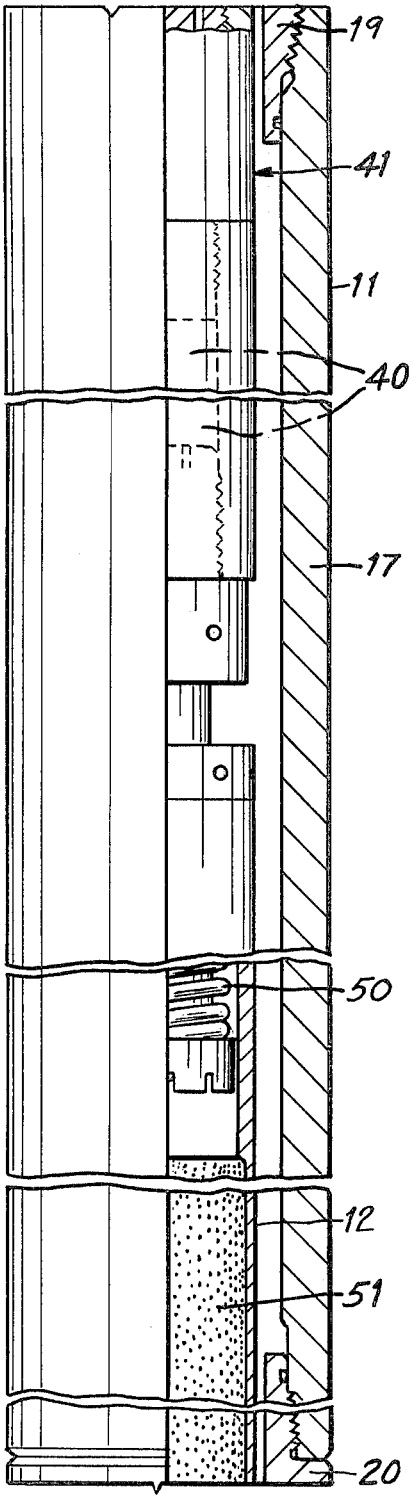
FIG. 2B is similar to FIG. 1B with the elements in the closed sealing position.
Figure 1C:
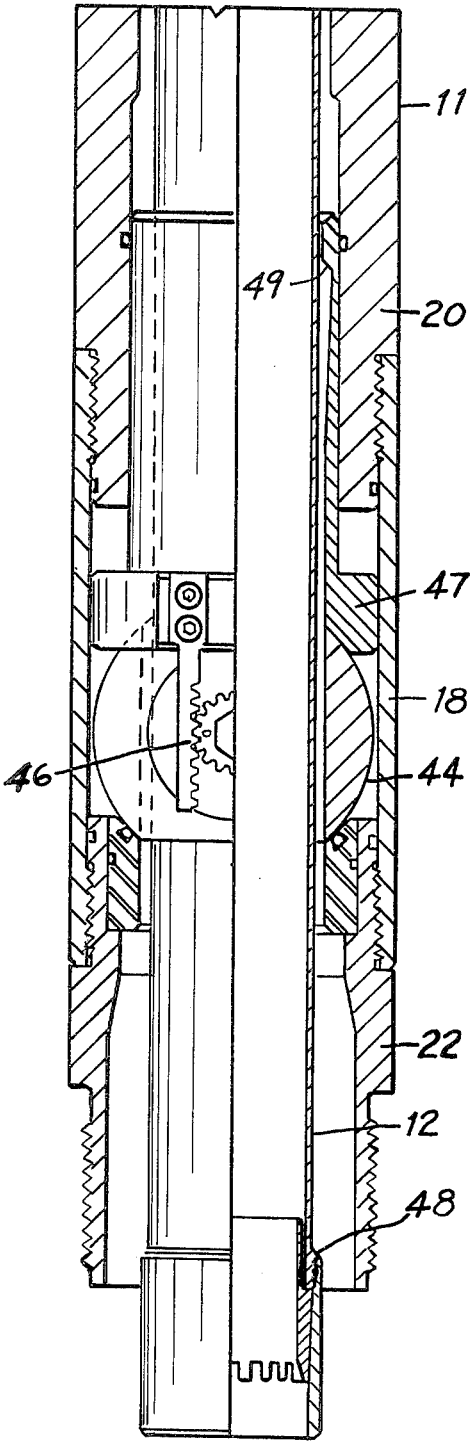
Figure 2C:
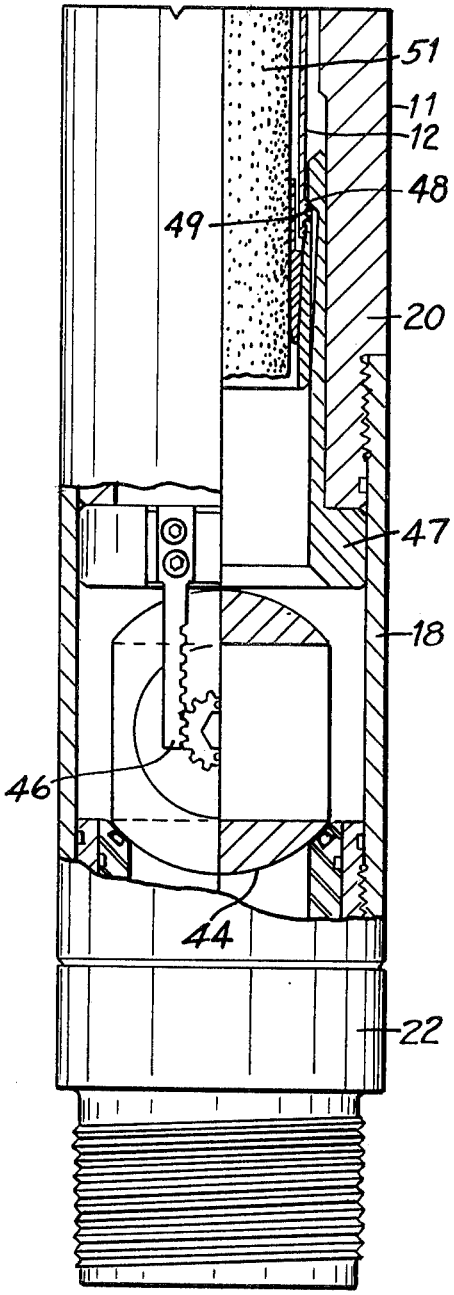

Referring now to FIGS. 1C and 2C the bottom sealing portion of the core barrel assembly is shown in detail. This includes a rotary ball valve of the same type as shown in the Blackwell et al patent, this valve being indicated at 44 as having a standard rack and pinion actuating mechanism 46 which is carried by a sleeve 47, these elements all being supported by the outer core barrel assembly. As the outer core barrel moves downwardly past the end of the core barrel during the sealing operation an enlarged section 48 on the end of the core barrel engages shoulder 49 on the upper portion of the valve actuating cylinder 47 as the outer barrel continues to move downwardly the actuating cylinder 47 moves relative to the ball valve 46, thus actuating the rack and pinion and closing the ball valve to a position shown in FIG. 2C. In the event there is an obstruction, closing of the ball valve is prevented by compression of the spring 50 which supports the bottom of the core barrel, as seen in FIG. 2B. This spring 50 is only partially compressed in the normal operation of the valve closing motion. The core sample is shown at 51.

In connection with the arrangement of elements shown in detail above it should be noted that the upper diameter of the outer core barrel which is subjected to full mud pressure is greater than the diameter of the inner core barrel where it is sealed to the outer barrel at seal 39. Accordingly there is a greater hydraulic force pushing downwardly on the outer barrel than on the inner barrel. Thus the outer barrel will be forced downwardly, not only by the force of gravity, but by this differential hydraulic pressure. This has the advantage of assuring that the outer barrel is moved downwardly to its sealed position despite friction in the well hole or other obstructions which might tend to prevent free travel of the outer barrel down to the closed position.

The operation of the device of the present invention is like that of Blackwell et al. When the core sample 51 has been taken, the whole assembly is raised a few feet off the bottom of the drill hole in preparation for sealing the core sample. Ball 35 is then pumped down the drill string until it seats on the valve 6. At this point the pressure in the drilling mud increases compressing the spring 33 thus moving latch actuating cylinder 32 downwardly. This releases the dogs 24 which move out of the lower cylindrical groove 30 thus releasing the outer barrel 11 to travel down, both under the force of gravity and the differential hydraulic pressure. The downward motion of the outer barrel continues until the differential pressure is released by the uncovering of the vent hole 38 as the top of the outer barrel 11 passes below these vent holes. At this low point the pressure drop above the ball 35 will be indicated at the well head. The mud pumping is then slowed and the spring 33 now has an upwardly exerting force on the actuating cylinder 32 thus tending to push the dogs 24 outwardly so that they are forced into the upper cylindrical groove 30 as soon as it is in the position shown in FIG. 2. The fact that the dogs have positively engaged the upper cylindrical groove 30 can be determined by lowering the assembly to the bottom of the drill hole. If these dogs are latched the outer core barrel will be retained in its locked position and the mud pressure will be continually vented thru the relief holes 38. If the dogs are not latched the outer core barrel will be pushed upwardly to seal these holes 38 and the hydraulic pressure will rise again in the interior of the drill string.

As the outer core barrel moves downwardly the shoulder 43 engages the upper portion of the nitrogen cut-off valve 42 and moves it downwardly to the position shown in FIG. 2A, providing pressurization of the core barrel. At the same time the nitrogen seal 52 has moved into the restricted cylindrical portion 54 of the outer core barrel forming the upper seal for the portion of the core barrel assembly to be pressurized by the nitrogen. The portion 54 is carried by the inner cylindrical surface of the sub 19. As pointed out above the pressurization of the space below the seal formed by surfaces 52 and 54 does not take place until the outer barrel has move essentially to the bottom of its path of travel.

In addition to opening the nitrogen cut-off, the movement of the valve 42 downwardly to the shoulder 45, positively prevents further downward motion to the outer barrel 11.

As mentioned previously the downward travel of the outer barrel has also actuated the ball valve 44 to close this valve and seal the core assembly. The core assembly is now at the predetermined pressure established for the sample. The sample is now raised to the surface in its sealed pressurized condition. At the surface all of the outer barrel structure above the sub 19 is removed as well as all of the inner core barrel assembly above the seal 52. This is then replaced as shown in FIG. 3 by an end cap 56 connected to a suitable supply of pressurized gas and flushing liquid schematically indicated at 58. Meanwhile the core bit is removed from the sub 22 and is replaced by a bottom pressure fitting 60. The assembly is then pressurized, the ball valve is opened by actuating a stem (not shown) extending to the exterior of the core barrel assembly and the mud is then flushed out by the use of a suitable medium through a pressurized vent 62. Thereafter the valve 44 is reclosed while the core is still at the desired high pressure, the sample is frozen and the end caps are removed. The core can then be suitably analyzed such as being sectioned and the like.

In those cases where the pressure core barrel assembly is designed to contain a maximum pressure of approximately 5000 p.s.i. the present invention permits taking a core sample at a depth having a pressure substantially in excess of 5000 p.s.i. The core barrel is then raised to a depth on the order of 5000 p.s.i. and then the slip joing assembly is tripped to seal the core at said 5000 p.s.i. and the pressurized core is then raised to the surface. Where very high pressure coring is to be done and the intermediate pressure sealing is employed, a rupture disc (set for 6000 p.s.i. for example) can be used to prevent surface explosions if the core barrel has been inadvertently sealed under abnormally high ambient pressure.

What is claimed is:

1. In a pressure core barrel assembly of the type having an inner barrel adapted to be connected to the lower end of a drilling string and including a core tube; an outer barrel slidably mounted around said inner barrel; a slip joing assembly for lockingly interconnecting said inner and outer barrels in a core cutting condition; means for tripping said slip joint assembly thereby permitting relative axial movement of said barrels to a core-retaining condition, the barrels in core-retaining condition defining an enclosed pressure chamber, said core tube being disposed in the pressure chamber with the barrels in said core retaining condition; a pneumatic control system carried by said inner barrel for maintaining a controlled pressure in said pressure chamber and a valve operated by said axial movement of said barrels for sealing the bottom of said outer barrel to form the bottom of the enclosed pressure chamber, the improvement which comprises means for providing full mud pump pressure to a portion of said outer barrel at a region thereof having an enlarged cross-sectional area, the inner and outer barrels being sealed to each other against full mud pump pressure at a region having a smaller cross-sectional area whereby said full mud pump pressure creates a force differential which moves said outer barrel downwardly to the core-retaining position.

2. The pressure core barrel of claim 1 providing means for venting full mud pump pressure when said outer barrel has moved axially to substantially its fully extended position.

3. The process of using a core barrel of the type described in claim 1 wherein the barrel is designed to contain a maximum pressure of approximately 5000 p.s.i. which comprises taking a core sample at a depth having a pressure substantially in excess of 5000 p.s.i., lifting the core barrel to a depth on the order of 5000 p.s.i. and then tripping the slip joint assembly to seal the core at said 5000 p.s.i.

4. In a pressure core barrel assembly of the type having an inner barrel adapted to be connected to the lower end of a drilling string and including a core tube; an outer barrel slidably mounted around said inner barrel; a slip joint assembly for lockingly interconnecting said inner and outer barrels in a core cutting condition; means for tripping said slip joint assembly thereby permitting relative axial movement of said barrels to a core-retaining condition, the barrels in core-retaining condition defining an enclosed pressure chamber, said core tube being disposed in the pressure chamber with the barrels in said core retaining condition; a pneumatic control system carried by said inner barrel for maintaining a controlled pressure in said pressure chamber and a valve operated by said axial movement of said barrels for sealing the bottom of said outer barrel to form the bottom of the enclosed pressure chamber, the improvement wherein the pneumatic control system, including all its valves, is supported by said inner barrel within said enclosed pressure chamber.

5. In a pressure core barrel assembly of the type having an inner barrel adapted to be connected to the lower end of a drilling string and including a core tube; an outer barrel slidably mounted around said inner barrel; a slip joint assembly for lockingly interconnecting said inner and outer barrels in a core cutting condition; means for tripping said slip joint assembly thereby permitting relative axial movement of said barrels to a core-retaining condition, the barrels in core-retaining condition defining an enclosed pressure chamber, said core tube being disposed in the pressure chamber with the barrels in said core retaining condition; a pneumatic control system carried by said inner barrel for maintaining a controlled pressure in said pressure chamber and a valve operated by said axial movement of said barrels for sealing the bottom of said outer barrel to form the bottom of the enclosed pressure chamber, the improvement wherein means are provided for opening the pneumatic control valve when the outer barrel has moved axially to substantially its fully extended position.

6. The pressure core barrel of claim 5 wherein the pneumatic control valve has a shoulder engaged by a corresponding shoulder on the outer barrel, engagement of said shoulder as said outer barrel moves downwardly first opening the control valve and then serving to limit the extent of travel of said outer barrel with respect to said inner barrel.

7. In a pressure core barrel assembly of the type having an inner barrel adapted to be connected to the lower end of a drilling string and including a core tube; an outer barrel slidably mounted around said inner barrel; a slip joint assembly for lockingly interconnecting said inner and outer barrels in a core cutting condition; means for tripping said slip joint assembly thereby permitting relative axial movement of said barrels to a core-retaining condition, the barrels in core-retaining condition defining an enclosed pressure chamber, said core tube being disposed in the pressure chamber with the barrels in said core retaining condition, a pneumatic control system carried by said inner barrel for maintaining a controlled pressure in said pressure chamber and a valve operated by said axial movement of said barrels for sealing the bottom of said outer barrel to form the bottom of the enclosed pressure chamber, the improvement wherein the slip joint includes latch means having dogs carried by the inner barrel for engaging upper and lower grooves in the outer barrel, the latch means holding the outer barrel in both drilling and extended positions, said latch means being released when full mud pump pressure is applied to the interior of the core barrel above a closed mud valve in the core barrel.

8. The pressure core barrel assembly of claim 7 wherein said latch dogs are supported by recesses in said inner barrel so as to engage continuous grooves on said outer barrel, said barrels being connected by splines and there being more splines than latch dogs to permit circumferential rotation of said latch dogs during repair to compensate for wear in said grooves.

* * * * *